US006827491B2

(12) United States Patent
Kohl et al.

(10) Patent No.: US 6,827,491 B2
(45) Date of Patent: Dec. 7, 2004

(54) WIDE OPEN FEATURE FOR RECLOSABLE BAGS

(75) Inventors: James G. Kohl, Garden Ridge, TX (US); Edward Berich, New Braunfels, TX (US); Duane Piechocki, Pleasantville, NY (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/145,000

(22) Filed: May 14, 2002

(65) Prior Publication Data

US 2003/0215160 A1 Nov. 20, 2003

(51) Int. Cl.[7] ..... B65D 33/16
(52) U.S. Cl. ..... 383/64; 383/33; 383/35
(58) Field of Search ..... 383/33, 35, 63, 383/64

(56) References Cited

U.S. PATENT DOCUMENTS 4,541,117 A * 9/1985 Ashbeck ..... 383/64
4,796,300 A * 1/1989 Branson ..... 383/63
4,869,725 A * 9/1989 Schneider et al. ..... 604/408
5,037,138 A * 8/1991 McClintock et al. ..... 383/34
5,174,658 A * 12/1992 Cook et al. ..... 383/33
5,852,830 A * 12/1998 Horn ..... 4/144.1
6,290,392 B1 * 9/2001 Sandor ..... 383/33

* cited by examiner

*Primary Examiner*—Jes F. Pascua
(74) *Attorney, Agent, or Firm*—Pitney Hardin LLP

(57) ABSTRACT

A reclosable plastic bag (10*a*, 10*b*) having a front wall (12) and a rear wall (14), opposed sides (16, 18) and an open top end (24) has a zipper (22) extending across the front and rear walls (12, 14) from side to side at the bag top. The zipper (22) includes first and second profiles (17, 19) having mating interlocking portions (26, 28). A camber inducing member (30, 32) is provided at the bag top on at least one of the profiles (17, 19) or the front and rear walls (12, 14) to urge the top end of the front wall (12) away from the top end of the rear wall (14) when the mating interlocking portions are disengaged from one another.

6 Claims, 2 Drawing Sheets

WIDE OPEN FEATURE FOR RECLOSABLE BAGS

FIELD OF THE INVENTION

The present invention relates to reclosable plastic bags of the type having a zipper with mating interlocking members. More specifically, the present invention relates to an improved bag and method of producing such bag to include a spring portion so that the mouth of the bag normally assumes a wide open position when the interlocking members are disengaged.

DESCRIPTION OF THE PRIOR ART

The present invention relates to improvements in the package-making art and may be practiced in the manufacture of reclosable thermoplastic bags and packages of the kind that may be used for storage or as primary packaging for various consumer products. Such packages include a zipper means at the bag opening to facilitate reclosing of the bag to protect any remainder of the contents therein. The zipper may be slider-less or may include a slider to facilitate its operation.

The indicated art is fairly well developed but nevertheless remains open to improvements contributing to increased efficiency and ease of operation. In the prior art, the zipper could be formed integrally with the walls of the bag or attached in the form of a separate zipper strip. In either case, when the zipper is opened the individual profiles making up the zipper tend to remain together with one profile of the zipper resting on the other profile albeit with the interlocking elements of the profiles disengaged. This could make it difficult to fill or empty the bag.

SUMMARY OF THE INVENTION

Accordingly, the present invention relates to a reclosable bag and method for producing a reclosable plastic bag with an opening feature wherein when the interlocking elements of the zipper profiles are disengaged, the mouth of the bag assumes a wide open posture. To obtain the wide opening feature, a camber inducing strip is provided adjacent the bag top on one or both sides of the bag. The camber inducing strip may be co-extruded with the zipper, on one or both profiles of the zipper, positioned behind the interlocking elements or above or below the zipper interlocking elements.

BRIEF DESCRIPTION OF THE DRAWINGS

Further objects and advantages of the invention will become apparent from the following description and claims and from the accompanying drawings, wherein:

DETAILED DESCRIPTION OF THE PREFERRED EMBODIMENT

Figure 1:
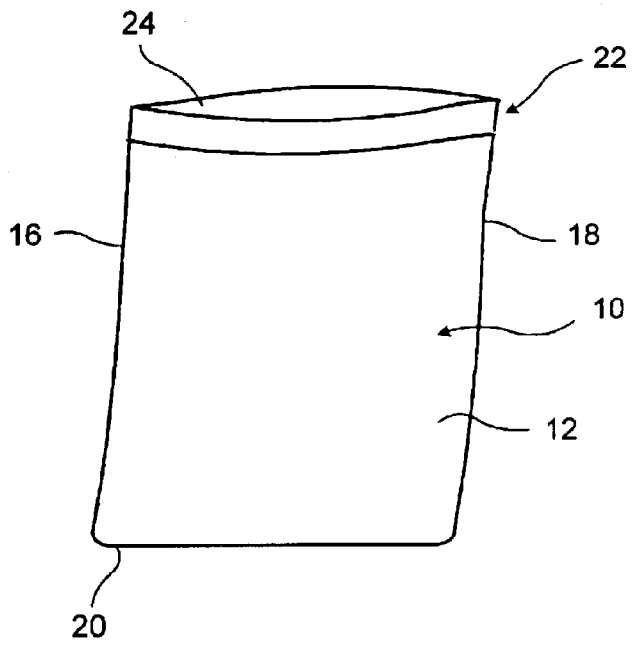
FIG. 1 PRIOR ART
FIG. 1 is a perspective view of a conventional reclosable bag.
Figure 2:
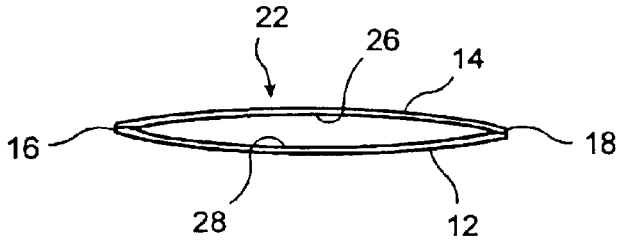
FIG. 2 PRIOR ART
FIG. 2 is a top plan view of the bag of FIG. 1 depicting the position normally assumed by the mouth of such a bag.

Reference is now made to the drawings wherein like numerals indicate like elements throughout the several views. In FIGS. 1 and 2 a conventional reclosable plastic bag 10 is depicted having front wall 12 and rear wall 14 formed of a plastic film which are joined at the sides 16, 18 and bottom 20. A zipper 22 is provided at or adjacent to the open bag top 24. The zipper 22 comprises a pair of profiles 17, 19 having mating interlocking members 26, 28 designed to inter-engage with each other. When the interlocking members are engaged, they form a closure for the bag top, holding the front wall 12 to the rear wall 14. When the interlocking members are disengaged, the front wall 12 is not held adjacent to the rear wall 14 but tends to remain adjacent to rear wall 14 requiring that the user separate the two to facilitate access to the bag interior.

In accordance with the present invention the tops of the front and rear walls 12, 14 of bag 10*a* are maintained apart when the profile interlocking members are disengaged by virtue of camber inducing strips 30, 32 respectively on the back surfaces of one or both of the front or rear walls or the zipper profiles. The camber inducing strips 30, 32 may be directly behind the interlocking elements 26, 28 or may be slightly offset above or below the interlocking elements so as to still be relatively close to the bag top. The camber inducing strips may, for example, comprise lengths of plastic co-extensive with the zipper having a retained coil memory that is overcome when the profile interlocking members engage but which tend to assume their coiled, bag opening, orientation when the interlocking members are disengaged. The camber inducing strips may be co-extruded on the zipper profiles on the side opposite to the side containing the interlocking members or may be separate strips bonded to the zipper.

Figure 3:
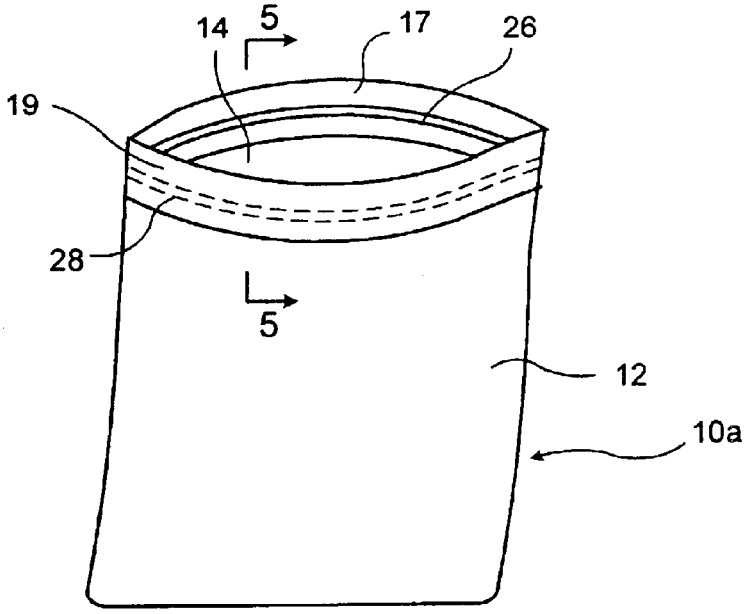
FIG. 3 is a perspective view of a reclosable bag in accordance with the present invention.
Figure 4:
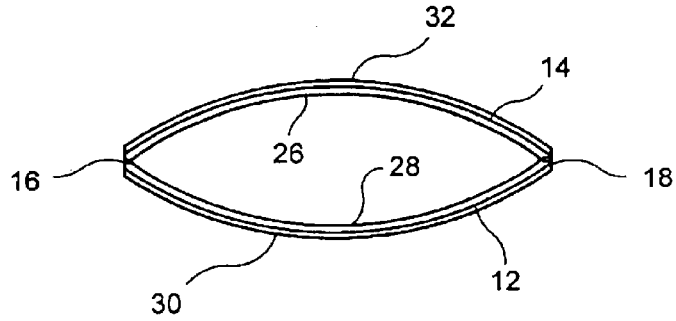
FIG. 4 is a top plan view of the bag of FIG. 3.
Figure 5:
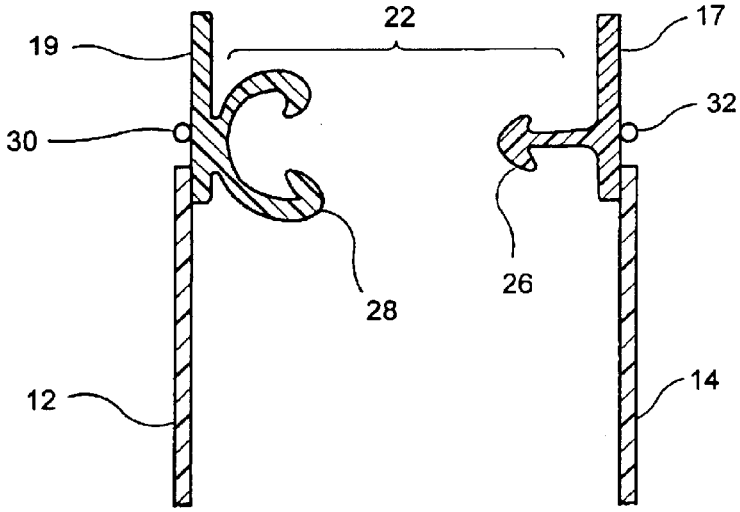
FIG. 5 is a fragmentary side sectional view taken along reference lines 5—5 of FIG. 3.
Figure 6:
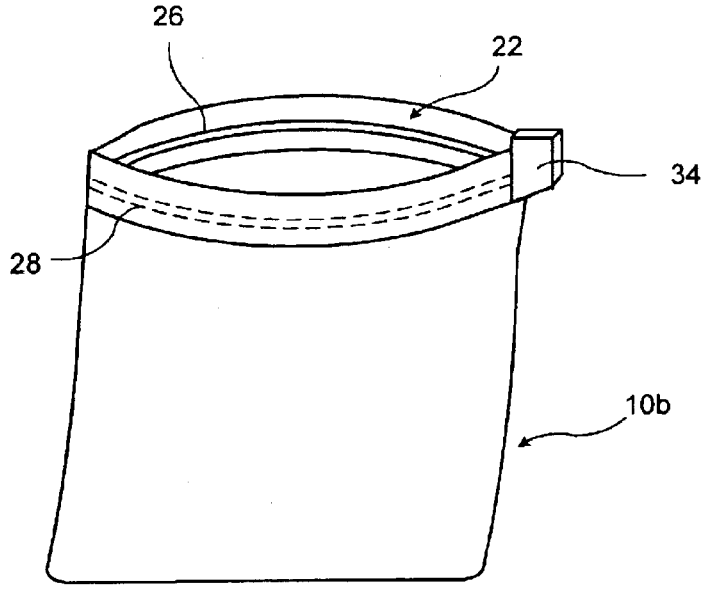
FIG. 6 is a perspective view of a modified reclosable bag in accordance with the present invention.

In FIG. 6 a modified reclosable plastic bag 10*b* is depicted in which the zipper 22 is provided with a slider 34. The zipper is generally of the type depicted in FIGS. 3–5. That is, the zipper is provided with a camber inducing strip on one or both profiles so that when the slider 34 is in the fully open position, depicted in FIG. 6, the camber inducing strips serve to maintain the bag mouth open.

What is claimed is:

1. A reclosable plastic bag having a front wall and a rear wall, opposed sides and an open top end, a zipper including first and second profiles secured to said front and rear walls along said open top end from side to side, said zipper including first and second profiles having mating interlocking portions extending from said open top end, a slider disposed for movement along said zipper to engage and disengage said mating interlocking portions and a camber inducing member at said open top end on an exterior face of at least one of said first and second profiles, said camber inducing member urging a top end of said front wall away from a top end of said rear wall when said mating interlocking portions are disengaged from one another.

2. The reclosable plastic bag in accordance with claim 1 wherein said camber inducing member is positioned on a side of said one of said first and second profiles opposite to a side containing said mating interlocking portion.

3. The reclosable plastic bag in accordance with claim 1 wherein said camber inducing member comprises a strip of plastic material.

4. The reclosable plastic bag in accordance with claim 1 wherein each of said front and rear walls includes a camber inducing member.

5. The reclosable plastic bag in accordance with claim 3 wherein said strip of plastic material is co-extruded with said zipper.

6. A method of manufacturing a reclosable plastic bag having a front wall and a rear wall, opposed sides and an open top end, a zipper extending across said front and rear walls along said open top end from side to side, said zipper including first and second profiles having mating interlocking portions extending from said open top end and a slider disposed for movement along said zipper to engage and disengage said mating interlocking portions, said method including the step of forming a camber inducing member at said open top end on an exterior face of at least one of said first and second profiles, said camber inducing member urging a top end of said front wall away from a top end of said rear wall when said mating interlocking portions are disengaged from one another.

* * * * *